US007446247B2

(12) United States Patent
Shellhammer

(10) Patent No.: US 7,446,247 B2
(45) Date of Patent: Nov. 4, 2008

(54) SUSPENDED BRACING SYSTEM FOR ACOUSTIC MUSICAL INSTRUMENTS

(75) Inventor: Hubert Michael Shellhammer, San Jose, CA (US)

(73) Assignee: Morgan Hill Music, Morgan Hill, CA (US)

( * ) Notice: Subject to any disclaimer, the term of this patent is extended or adjusted under 35 U.S.C. 154(b) by 51 days.

(21) Appl. No.: 11/682,736

(22) Filed: Mar. 6, 2007

(65) Prior Publication Data

US 2008/0028910 A1 Feb. 7, 2008

Related U.S. Application Data

(60) Provisional application No. 60/821,365, filed on Aug. 3, 2006.

(51) Int. Cl.
*G10D 1/08* (2006.01)
*G10D 1/00* (2006.01)

(52) U.S. Cl. ..... 84/291; 84/291; 84/267

(58) Field of Classification Search ..... 84/267, 84/291

See application file for complete search history.

(56) References Cited

U.S. PATENT DOCUMENTS 651,146 A * 6/1900 Rogers ..... 84/267
738,811 A * 9/1903 Johnson ..... 84/268
2,020,557 A * 11/1935 Loar ..... 84/726
2,031,706 A * 2/1936 Hambrecht et al. ..... 84/294
2,113,446 A * 4/1938 Gugino ..... 84/293
2,270,612 A * 1/1942 Williams ..... 84/267
3,892,159 A * 7/1975 Houtsma ..... 84/307
4,026,181 A * 5/1977 Barcus et al. ..... 84/291
4,206,678 A * 6/1980 Espinos Guerrero ..... 84/267
5,260,505 A * 11/1993 Kendall ..... 84/298
5,339,718 A * 8/1994 Leduc ..... 84/291
5,410,936 A * 5/1995 Ellsworth et al. ..... 84/298
5,549,027 A * 8/1996 Steinberger et al. ..... 84/297 R
5,661,252 A * 8/1997 Krawczak ..... 84/291
5,679,910 A * 10/1997 Steinberger et al. ..... 84/291
5,686,677 A * 11/1997 Herbert ..... 84/307
5,922,979 A * 7/1999 Yui ..... 84/291
5,998,712 A * 12/1999 Schmidt ..... 84/291
6,060,650 A * 5/2000 McPherson ..... 84/291
6,166,308 A * 12/2000 Lam ..... 84/291

(Continued)

OTHER PUBLICATIONS

Breedlove Guitars, "Gallery 02—Internal Views", http://www.breedloveguitars.com/gallery/02/jid_close.jpg; Retrieved from the Internet Jan. 31, 2007.

(Continued)

*Primary Examiner*—Lincoln Donovan
*Assistant Examiner*—Robert W Horn
(74) *Attorney, Agent, or Firm*—Michael A. Glenn; Glenn Patent Group

(57) ABSTRACT

A suspended bracing system is disclosed that allows the sound board of an acoustic instrument, such as a guitar, to vibrate more. As a result, the instrument projects more tone and volume than that provided by conventional guitar sound boards. Conventional sound boards have wood or synthetic bracing glued all across the sound board. This is to prevent the bridge from pulling up when the strings are tightened to pitch. Using the suspended system, the invention disclosed herein secures the bridge, but drops the bracing below the sound board of the guitar to allow the sound board more freedom to vibrate.

17 Claims, 4 Drawing Sheets

U.S. PATENT DOCUMENTS

| | | | | |
|---|---|---|---|---|
| 6,459,024 | B1 * | 10/2002 | Baker | 84/291 |
| 6,646,190 | B2 * | 11/2003 | Brown | 84/291 |
| 7,115,803 | B2 * | 10/2006 | Machida | 84/294 |
| 2008/0028910 | A1 * | 2/2008 | Shellhammer | 84/291 |
| 2008/0053288 | A1 * | 3/2008 | Brunkalla | 84/267 |

OTHER PUBLICATIONS

Guitar Gallery—Tom Bills Guitars published Nov. 24, 2002, retrieved from http://web.archive.org/web/20021124033903/http://guitargal.com/bills.html.

* cited by examiner

SUSPENDED BRACING SYSTEM FOR ACOUSTIC MUSICAL INSTRUMENTS

CROSS REFERENCE TO RELATED APPLICATIONS

This application claims priority to U.S. provisional patent application Ser. No. 60/821,365, filed 3 Aug. 2006, the entirety of which is incorporated herein by this reference thereto.

BACKGROUND OF THE INVENTION

1. Technical Field

The invention relates to acoustic musical instruments. More particularly, the invention relates to a suspended bracing system for acoustic musical instruments.

2. Description of the Prior Art

In an acoustic musical instrument, such as a guitar, bracing performs two different functions:

It strengthens the sound board of the instrument; and

It allows the sound board of the instrument to vibrate sufficiently to produce a warm and resonant tone.

In a standard scale guitar having medium gauge strings, the guitar's sound board withstands approximately 185 lbs of constant tension. Tension must be considered both at those points where the sound board of the instrument joins the instrument body, and at that point where the sound board of the instrument supports the instrument bridge. A thin sound board that is not braced would buckle or warp in very little time. A sound board thick enough to withstand the pressure could not vibrate sufficiently and would result in a thin tone with little volume.

Bracing plays a major role in determining the tone of a guitar as well. See FIG. 1, for example, which is a plan view that shows a typical bracing pattern for a steel string acoustic guitar. Although there are many theories about tone production as related to bracing, there is little disagreement on its importance. A luthier makes purposeful decisions about the placement, pattern, and physical shape of bracing because, in many ways, these decisions affect the final tone of the instrument as much as the actual tone wood. For instance, Taylor Guitars' distinctive voice is heavily influenced by their bracing patterns. Likewise, vintage Martin guitars are prized for the shape of the braces and how they affect tone. It is well recognized that too much bracing produces a guitar that has a dead, muffled tone; while too little bracing results in poor structural integrity, as well as producing a guitar that has an airy tone with no definition.

The bracing pattern found in most steel-string dreadnoughts is the "X" pattern. Originally developed by C. F. Martin in the 1850's, this pattern features the two main braces running in an "X" from the upper bouts to the lower bouts. The "X" crosses somewhere between the sound hole and the bridge. There are several auxiliary braces other than the main X-braces. This pattern provides the strength and well-balanced tonal palette that most builders find attractive.

One problem with current bracing schemes for guitars and other acoustic instruments is that, while adding strength to the sound board of the instrument, even the most effective bracing currently used still necessarily diminishes the ability of the instrument sound board to vibrate. It would be advantageous to provide a bracing system for acoustic musical instruments that imparted necessary support to the sound board of the instrument, while minimizing interaction of the bracing with the sound board that reduces or interferes with the sound produced by the sound board of the instrument.

SUMMARY OF THE INVENTION

The presently preferred embodiment of the invention comprises a suspended bracing system that allows the sound board of an acoustic instrument, such as a guitar, to vibrate more. As a result, the instrument projects more tone and volume than that provided by conventional guitar sound boards. Conventional sound boards have wood or synthetic bracing glued all across the sound board. This is to prevent the bridge from pulling up when the strings are tightened to pitch. Using the suspended system, the invention disclosed herein secures the bridge, but drops the bracing below the sound board of the guitar to allow the sound board more freedom to vibrate.

DETAILED DESCRIPTION OF THE INVENTION

Figure 1:
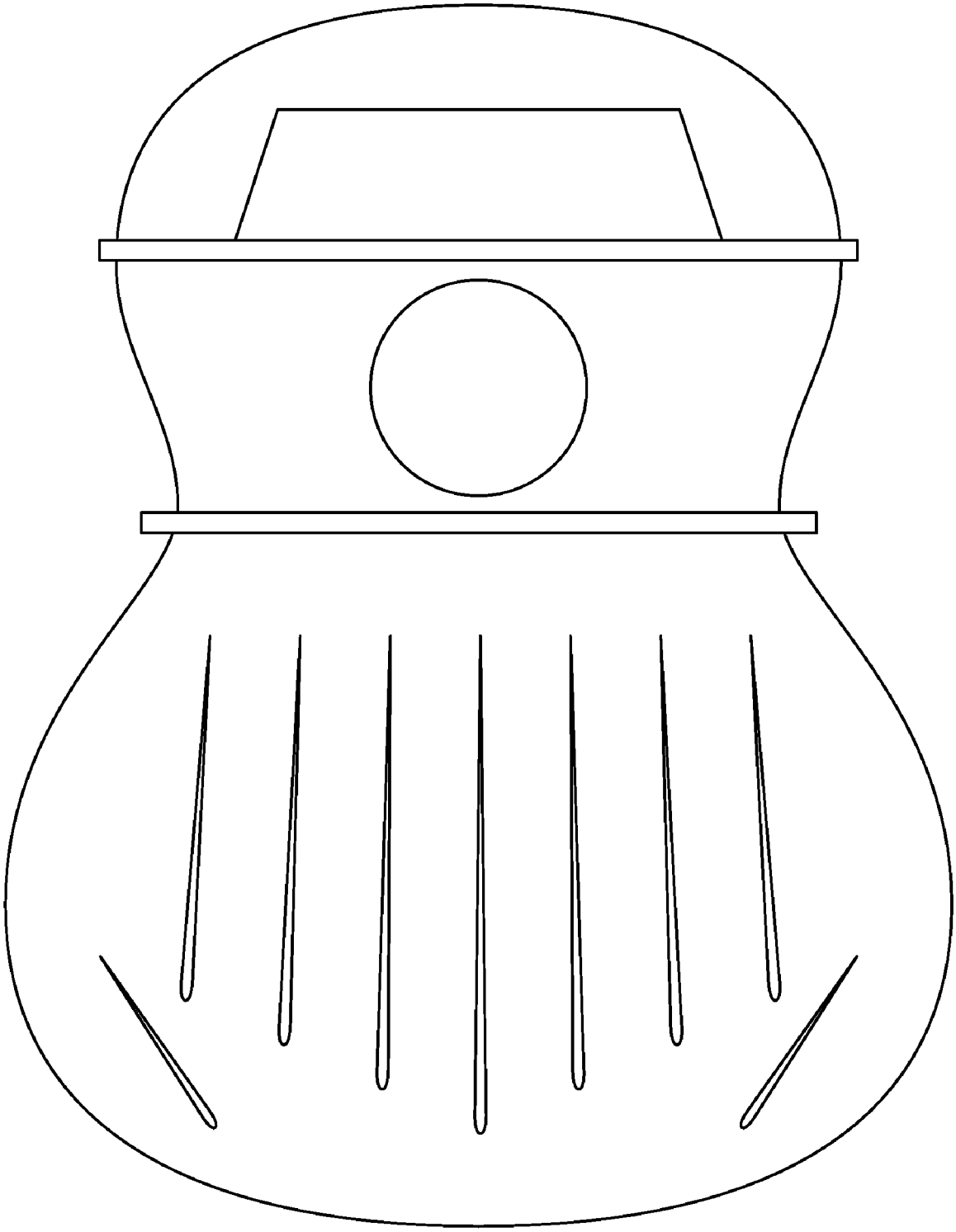
FIG. 1 (Prior Art)
FIG. 1 is a plan view that shows a typical bracing pattern for a steel string acoustic guitar.

The presently preferred embodiment of the invention comprises a suspended bracing system that allows the sound board of an acoustic instrument, such as a guitar, to vibrate more. As a result, the instrument projects more tone and volume than that provided by conventional guitar sound boards. Conventional sound boards have wood or synthetic bracing glued all across the sound board, as shown in FIG. 1. This is to prevent the bridge from pulling up when the strings are tightened to pitch. Using the suspended system, the invention disclosed herein secures the bridge, but drops the bracing below the sound board of the guitar to allow the sound board more freedom to vibrate.

Figure 2:
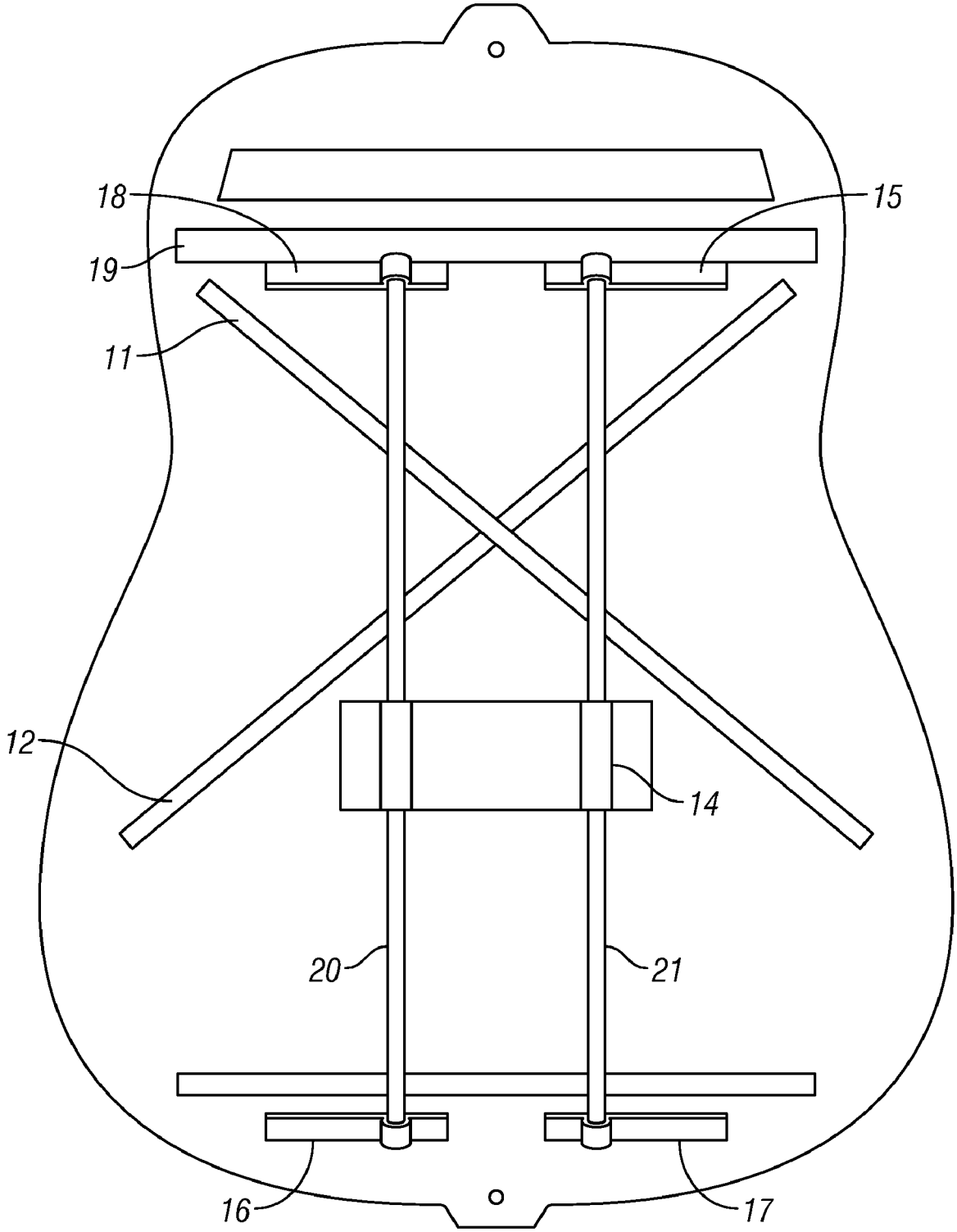
FIG. 2 is a plan view that shows a suspended bracing system for a steel string acoustic guitar according to the invention.

FIG. 2 is a plan view that shows a suspended bracing system for a steel string acoustic guitar according to the invention. Those skilled in the art will appreciate that, while the invention is described herein in connection with an acoustic steel string guitar, the invention finds application to any acoustic instrument having a sound board, such as a classical guitar, ukulele, mandolin, violin, cello, bass, and the like. Further, such bracing systems may comprise any number of points of contact to the sound board, such as three-points or more of contact. For example, FIG. 2 shows a five-point suspended bracing system in which two rigid rods 20, 21 are fixed to a guitar sound board 19 by four members 15, 16, 17, 18, each of which defines an aperture that receives a respective end of a rod. The rods are rigid and impart structural integrity to the sound board without unnecessarily contacting the sound board, which would otherwise interfere with the ability of the sound board to vibrate. The rods project through apertures formed through a bridge support member 14. In the presently preferred embodiment, the rods are ⅝" aluminum rods. Such rods may be solid or hollow. Aluminum is light, strong, vibrates freely, and has excellent memory in returning back to its original position. It also does not warp when exposed to moisture or extreme temperature changes. Further, other diameters may be used for the rods; the rods may be formed of other materials, such as glass, plastics or resins, wooden dowels, steel, or the like; and other than two rods may be used. Further, while the rods are shown as continuous rods that extend without interruption from one edge of the sound board to the other edge of the sound board, the rods may be compound rods. That is, one or more rods may extend from one edge of the sound board to the bridge support member. One or more other rods may extend from the bridge support member to the other edge of the sound board. In this way, a support pattern, such as for example a fan pattern, can be provided. In this embodiment, three or more rods may extend from the bridge support member to the tail edge of the sound board, while two rods would extend from the bridge support member to the heel (neck) edge of the sound board. Those skilled in the art will appreciate that the pattern chosen is a matter of choice. The inventors have found that the presently preferred embodiment, shown in FIG. 2, provides excellent acoustic and structural qualities.

The embodiment of FIG. 2 shows a bracing system having five points of attachment to the sound board of the instrument. A separate member is provided at each end of each rod to receive the end of the rod and retain same to the instrument sound board. Those skilled in the art will appreciate that a single member may be provided at each edge of the instrument sound board, the member defining two apertures, each of which receives an end of one of the two respective rods. Such system involves fewer pieces because only three points of attachment to the instrument sound board via three members are necessary, i.e. two terminal members, one at each edge of the sound board, and one bridge support member. In the presently preferred embodiment, the members themselves are attached to the sound board of the instrument with any conventional adhesive or bonding material. Although the actual manner of attachment is a matter of choice, the use of adhesives is preferred to the use of mechanical means, such as screws and the like. The members themselves may be made of any material, such as cast or machined metals, plastics or resins, wood, or the like.

Figure 3:
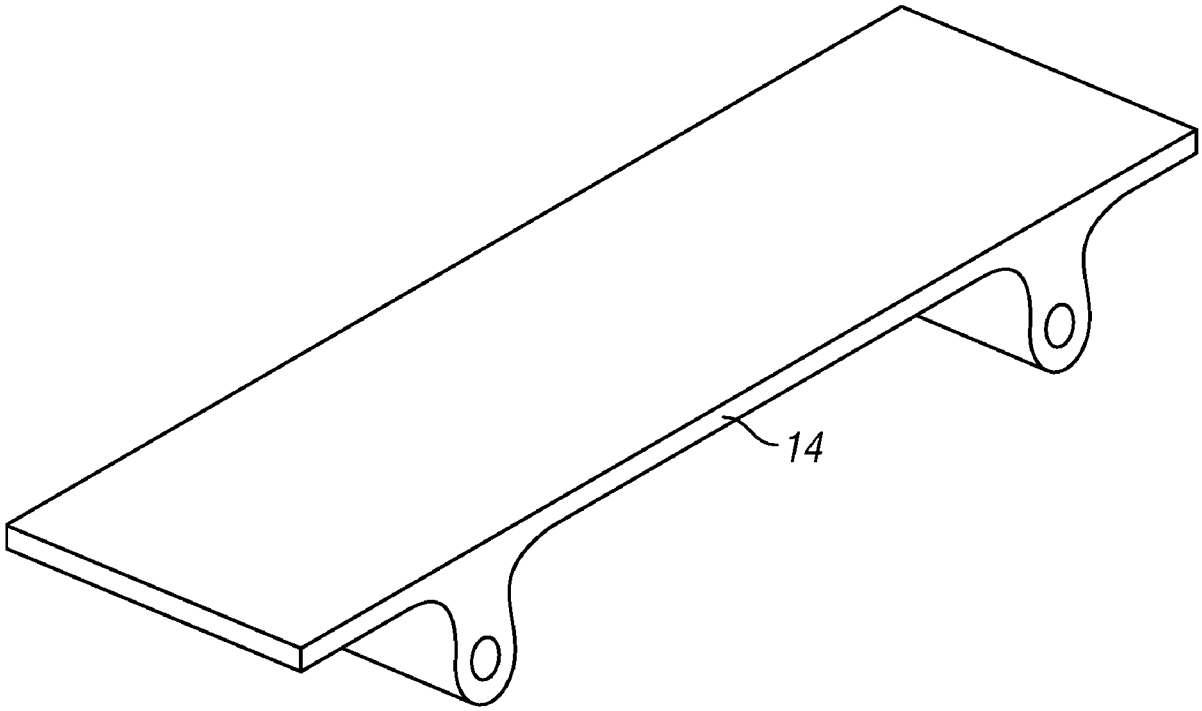
FIG. 3 is a perspective view of a bridge support in a suspended bracing system for a steel string acoustic guitar according to the invention.

The bridge member is shown in FIG. 2 as a single member having two apertures formed therethrough, each for receiving a respective one of the two rods. FIG. 3 is a perspective view of a bridge support 14 in a suspended bracing system for a steel string acoustic guitar according to the invention. This arrangement is useful for a side-ported guitar, as discussed below. For an instrument having a conventional opening or sound hole in the sound board, two such bridge members, one for each rod, may be used; or the spacing of the apertures from each other may be selected so that the rods do not traverse the opening in the sound board defined by the sound hole. While this is not acoustically necessary, it is aesthetically pleasing. In this regard, the rods may also be bent to curve around the sound hole opening.

The bridge members may be made of any material, such as cast or machined metals, plastics or resins, wood, or the like, are attached to the sound board of the instrument with any conventional adhesive or bonding material. Although the actual manner of attachment is a matter of choice, the use of adhesives is preferred to the use of mechanical means, such as screws and the like. The support shown in FIG. 3 is 170 mm long, 45 mm wide, and 5 mm thick. The apertures are 9.54 mm in diameter and are spaced apart by 120 mm. Those skilled in the art will appreciate that any dimensions can be chosen, depending upon the application to which the invention is put. For example, the dimensions would be smaller for a ukulele and larger for an acoustic bass.

Optionally, a cross brace 11, 12 or other additional bracing may be incorporated into the sound board, for example, if a side-ported configuration is desired, as discussed below in connection with FIG. 3. However, the invention herein is readily practiced with or without such additional bracing. In the example of FIG. 2, the braces has lengths of 400 mm (upper left), 163 mm (upper right), 230 mm (lower left), and 300 mm (lower right), although the actual length of such braces is a matter of choice for the skilled person, should such braces be provided at all.

In still other embodiments of the invention, the entire suspension system can comprise any of a unitary, synthetic molded system glued to the bottom of the sound board, a wood suspended system glued to the bottom of the sound board, or a wood or synthetic frame and aluminum rods used in the suspended support system (for example, as shown in FIG. 2). A suspended system can also be achieved by extending two aluminum rods from the neck connected to a wooden pin block under the bridge. A suspended system can also be achieved by securing the bridge to the back of the guitar, therefore allowing the sound board more freedom to vibrate.

Figure 4:
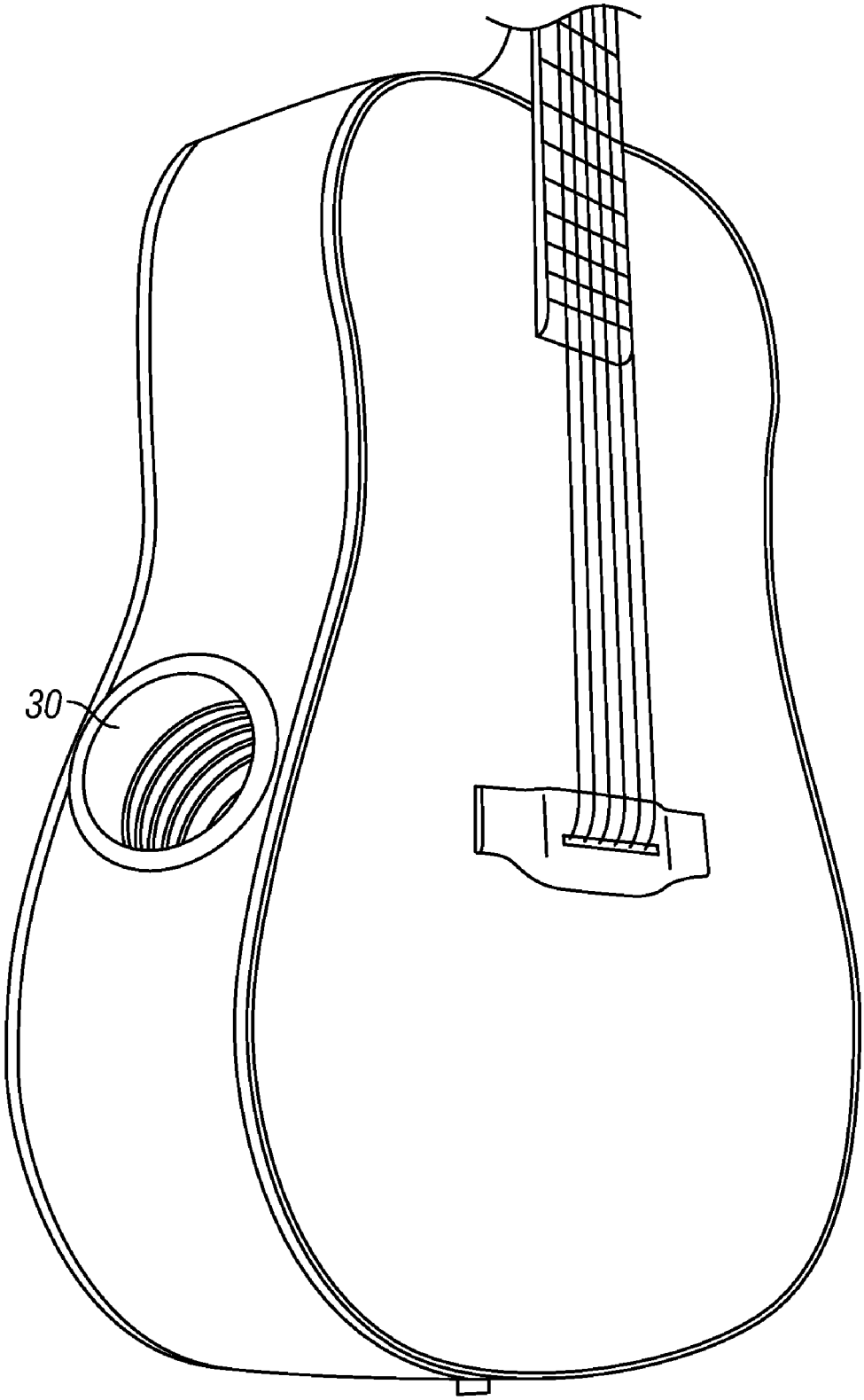
FIG. 4 is a perspective view that shows a side port for a steel string guitar according to the invention.

FIG. 4 is a perspective view that shows a side port for a steel string guitar according to the invention. In FIG. 4, the port is a 78 mm plastic port, although those skilled in the art will appreciate that the port may be formed of other materials, have other diameters, have other shapes, and that the port may be dispensed with altogether, a finished opening in the side of the guitar sufficing. The sound port is located on the sound board side of the guitar facing the player to allow the sound from the inside of the guitar to be directed to the player instead of outward towards the audience. This provides a guitar that provides a better idea of the performance to the musician, for example in a noisy environment, where the sound is projected from the sound hole must compete with sound generated by an audience, e.g. in a night club or concert venue. This also allows a musician to practice less intrusively because the sound of the instrument is directed to the musician's ears and not outwardly. Thus, the musician does not have to play as loudly to hear his performance.

In this embodiment, the sound board vibrates better because it now has more surface area without the 100 mm sound hole typically provided in the center of the sound board. While other guitars may have small holes or cutouts on the sound board side of the guitar, they also have a port somewhere on the front sound board of the guitar. The side port allows for better bracing of the sound board because the bracing pattern does not have to compensate for a lack of sound board rigidity due to the front sound port. Further, in this embodiment of the invention, the mid-frequency tones and high-frequency tones come from the front of the sound board and the low-frequency tones come more from the sound board sided port. Because low frequencies are more omnidirectional, the guitar still sounds excellent from the front.

Although the invention is described herein with reference to the preferred embodiment, one skilled in the art will readily appreciate that other applications may be substituted for those set forth herein Without departing from the spirit and scope of the present invention. Accordingly, the invention should only be limited by the Claims included below.

The invention claimed is:

1. An acoustic musical instrument, comprising:

a back and a sound board separated by a continuous side;

said side comprising a side port located on a sound board side of said instrument facing a player to allow sound from inside of said instrument to be directed to said player instead of outward towards an audience;

wherein said sound board is provided without any opening; and means suspended from two or more points of contact at respective edges of said sound board for supporting a portion of said sound board proximate to an instrument bridge in lieu of conventional sound board bracing, said means further comprising a multi-point suspended bracing system comprising:

at least two rigid rods fixed to respective edges of said guitar sound board by two or more respective members and extending therebetween, each of said members defining an aperture for receiving a respective end of a rod;

a bridge support member, wherein said rods project through apertures formed through said bridge support member.

2. A bracing apparatus for an acoustic instrument sound board, comprising:

means suspended from two or more points of contact at respective edges of said sound board for supporting a portion of said sound board proximate to an instrument bridge in lieu of conventional sound board bracing.

3. The apparatus of claim 2, further comprising a multi-point suspended bracing system.

4. The apparatus of claim 2, further comprising:

at least two rigid rods fixed to respective edges of said guitar sound board by two or more respective members and extending therebetween.

5. The apparatus of claim 4, further comprising:

each of said members defining an aperture for receiving a respective end of a rod.

6. The apparatus of claim 4, further comprising:

a bridge support member;

wherein said rods project through apertures formed through said bridge support member.

7. The apparatus of claim 4, wherein said rods are either solid or hollow.

8. The apparatus of claim 4, wherein said rods are made of aluminum.

9. The apparatus of claim 4, wherein rods comprise compound rods, wherein one or more first rods extend from one edge of said sound board to a bridge support member; and wherein one or more other rods extend from said bridge support member to the other edge of said sound board to define a support pattern.

10. The apparatus of claim 4, further comprising:

a separate member for each end of each rod to receive an end of said rod and retain same to said instrument sound board at an edge thereof.

11. The apparatus of claim 4, further comprising:

a single member at each edge of said instrument sound board, said member defining a plurality of apertures, each of which receives an end of a respective rod.

12. The apparatus of claim 4, wherein said members are attached to said sound board with any of an adhesive or bonding material.

13. The apparatus of claim 6, said bridge member comprising a single member having a plurality of apertures formed therethrough, each for receiving a respective one of a plurality of rods.

14. The apparatus of claim 13, wherein spacing of said apertures from each other is selected so that said rods do not traverse an opening in said sound board defined by a sound hole.

15. The apparatus of claim 6, wherein said bridge member is attached to said sound board with any of an adhesive or bonding material.

16. The apparatus of claim 2, said means comprising any of a unitary, synthetic molded system fixed to said sound board, a wood suspended system fixed to said sound board, or a frame and aluminum rods comprising a suspended support system.

17. The apparatus of claim 2, said means further comprising:

two rods extended from an instrument neck connected to a pin block under an instrument bridge.

* * * * *